United States Patent [19]

Baird

[11] Patent Number: 4,872,223

[45] Date of Patent: Oct. 10, 1989

[54] ORTHOPEDIC CHAIR

[76] Inventor: Lincoln F. Baird, 3482 Moore St., Los Angeles, Calif. 90066

[21] Appl. No.: 781,134

[22] Filed: Sep. 26, 1985

[51] Int. Cl.[4] ..... A47K 3/10

[52] U.S. Cl. ..... 4/480; 297/DIG. 10

[58] Field of Search ..... 4/480, 251; 297/DIG. 10, 339; 292/171

[56] References Cited

U.S. PATENT DOCUMENTS

| | | | |
|---|---|---|---|
| 2,572,730 | 10/1951 | Jones | 292/171 |
| 2,644,957 | 7/1953 | Shudde | 4/480 |
| 3,261,031 | 7/1966 | Gates | 4/480 |
| 3,473,174 | 10/1969 | Cool | 297/DIG. 10 |
| 3,539,220 | 11/1970 | Aguilar | 297/DIG. 10 |
| 3,640,566 | 2/1972 | Hodge | 297/DIG. 10 |
| 3,915,494 | 10/1975 | Somerset | 297/DIG. 10 |
| 4,461,160 | 7/1984 | Van Oompel | 292/171 |
| 4,474,393 | 10/1984 | Kimura | 292/171 |
| 4,538,853 | 9/1985 | Levenberg | 297/DIG. 10 |

FOREIGN PATENT DOCUMENTS

| | | | |
|---|---|---|---|
| 49034 | 1/1978 | Australia | 297/DIG. 10 |

*Primary Examiner*—Henry J. Recla
*Assistant Examiner*—L. J. Peters

[57] ABSTRACT

The present invention is an orthopedic chair which may be used to assist an invalid to easily sit therein or to rise thereform. The orthopedic chair includes a frame and a seat which is pivotally coupled to the frame at the front thereof, a back which is mechanically coupled to the frame, a right arm-rest and a left arm-rest both of which are mechanically coupled to the frame. The orthopedic chair also includes a spring tensioning mechanism which resiliently biases the seat, when it is in its first position, toward its second position and a releasing mechanism which releases the seat so that the spring tensioning mechanism moves the seat from its first position to its second position.

2 Claims, 6 Drawing Sheets

Fig. 1.
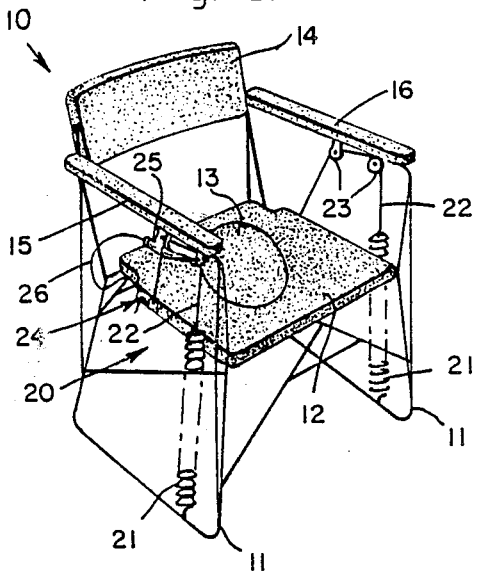
Fig. 2.
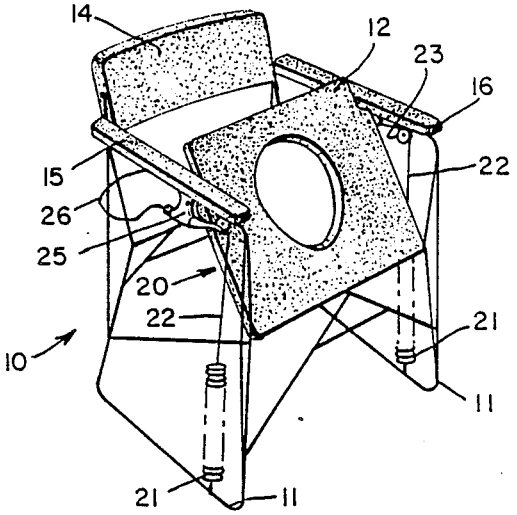
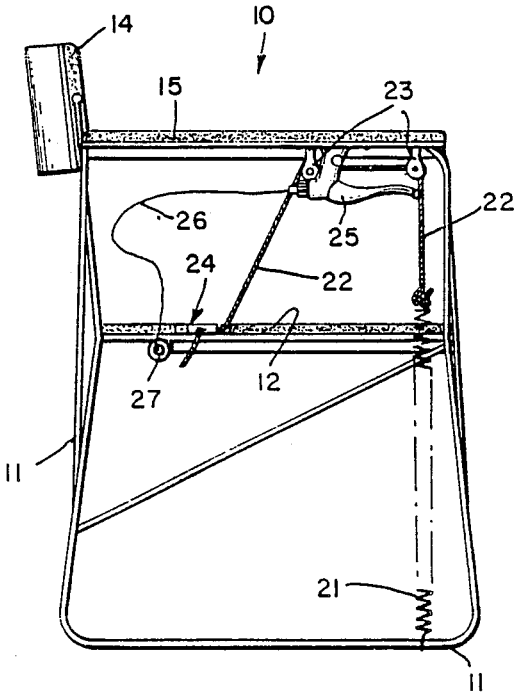
Fig. 3.
Fig. 4.
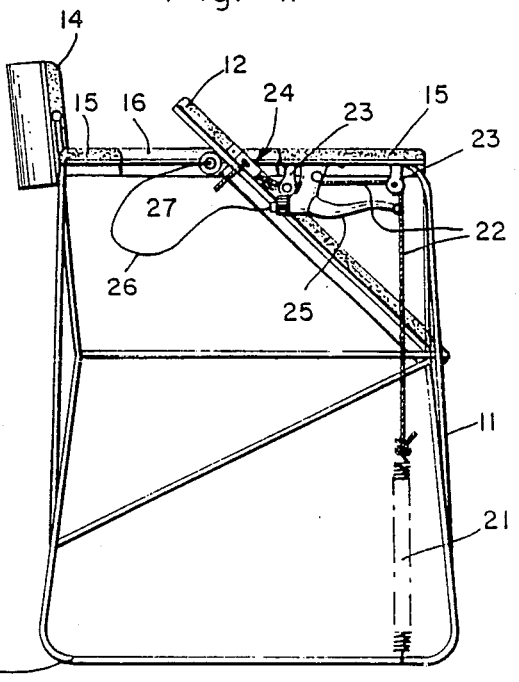

Fig. 5.
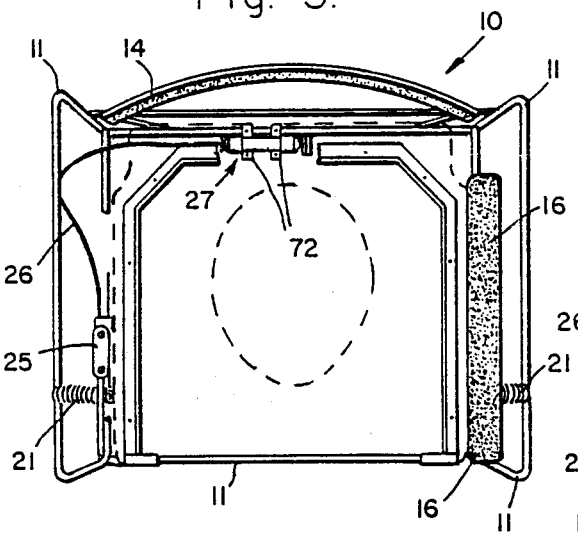
Fig. 6.
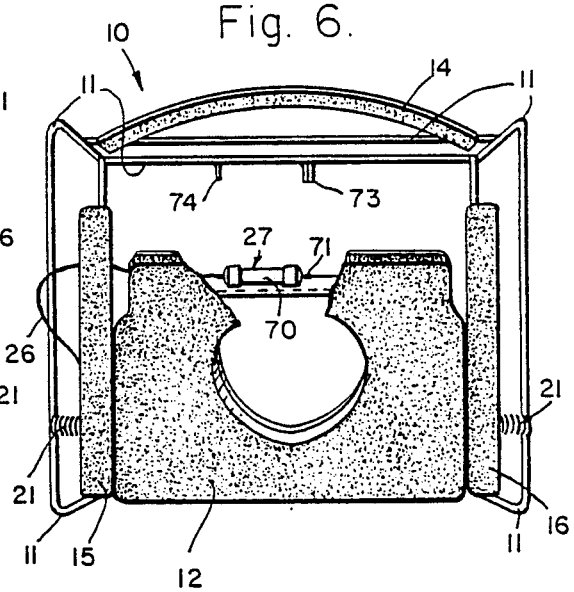
Fig. 7.
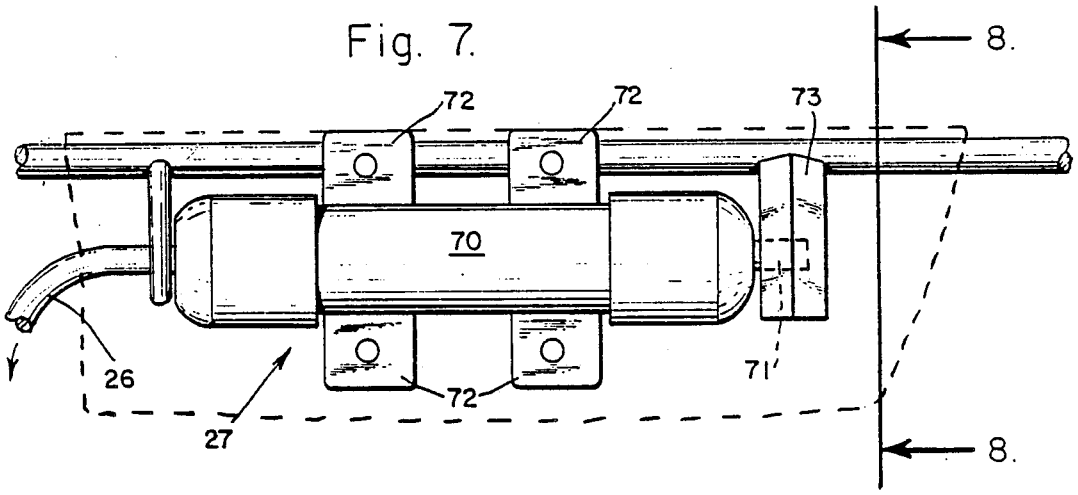
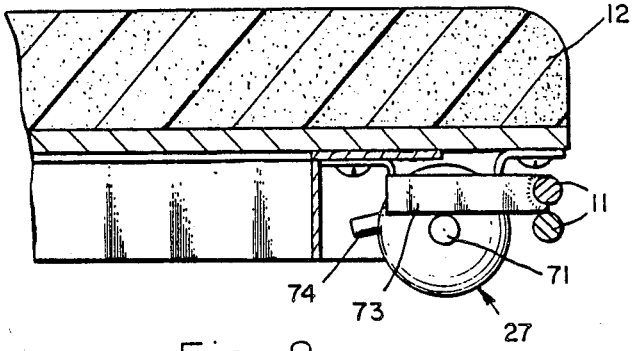
Fig. 8.

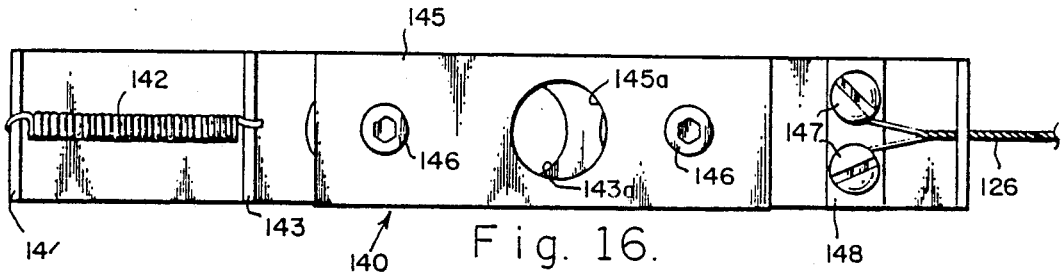
Fig. 16.
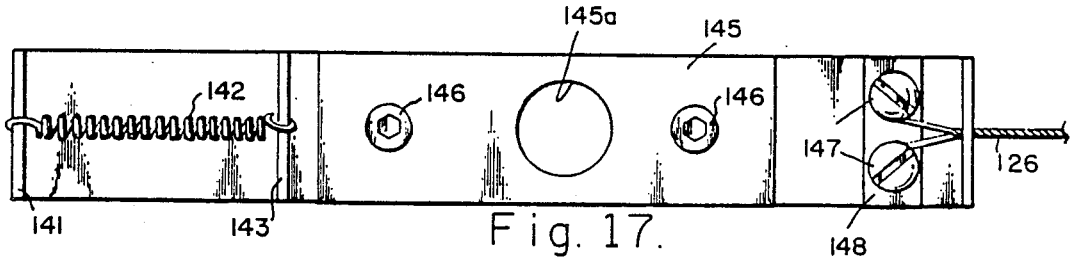
Fig. 17.
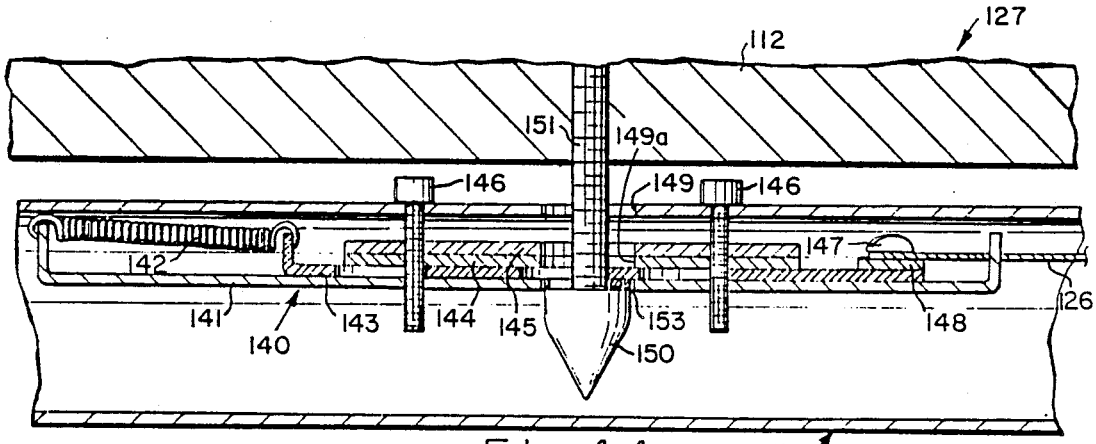
Fig. 14.
Fig. 13.
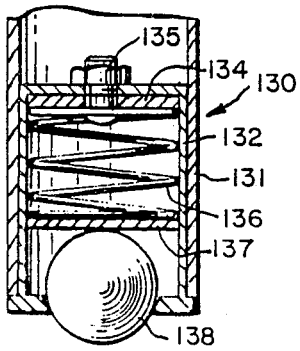
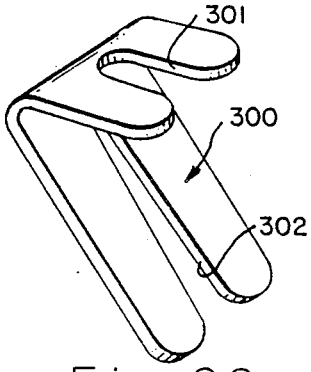
Fig. 22.
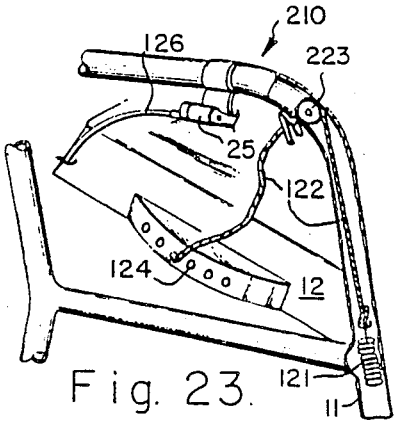
Fig. 23.

ORTHOPEDIC CHAIR

BACKGROUND OF THE INVENTION

1. Field of the Invention

The present invention relates to orthopedic chairs and more particularly to orthopedic chairs which assists an invalid to easily sit therein or to rise therefrom.

2. Description of the Prior Art

U.S. Pat. No. 4,538,853, entitled Chairs for Handicapped Persons, issued to Nat Levenberg on Sept. 3, 1985, teaches a chair with resilient mechanism for assisting an occupant in raising himself to a standing position. The seat cushion pivots relative to the chair frame about an axis near the rearward edge thereof. This movement also serves to at least partially simultaneously elevate the arm rest. When the chair is occupied, the resilient struts are compressed so that seat may be manually in position against strut compression.

U.S. Pat. No. 3,975,051 entitled Orthopedic Chair issued to Robert V. Ballagh on Aug. 17, 1976 teaches an orthopedic chair particularly adapted for the use of an invalid or patient suffering from disabling diseases such as arthritis, sciatica, or the like. The orthopedic chair includes a movable supported frame assembly that serves to maintain a forwardly and downwardly extending saddle-shaped seat at a desired elevation between a pair of laterally spaced side walls and a back rest. The frame movably supports first and second reversible electric motors that drive first and second mechanisms that pivot the first and second leg supports to desired angular positions relative to the first and second channels. First and second electric switch mechanisms are mounted at convenient locations on the first and second side walls to permit the user of the invention to selectively energize either the first and second members jointly or individually to pivot the first and second leg supports to desired angular positions. Due to the configuration of the saddle-shaped seat, the user in the orthopedic chair is at all times urged into a position where his feet are maintained in contact with foot rests that form a part of the leg supports. The orthopedic chair preferably has a source of electricity, such as a battery, removably mounted thereon in a conceraled position U.S. Pat. No. 4,358,156 entitled Floor Rest And Actuator For Chairs For Patients And Invalids issued to Harold M. Sharff on Nov. 9, 1982 teaches a chair which includes a relatively elevated seat with an adjustably pivoted foot rest. The foot rest can be positioned in both useful or out-of-the-way positions. The chair also includes an easily operable manual lever which occupant uses to move the foot rest in order to provide a comfortable foot support for invalids, particularly arthritics. There are many invalid chairs which have power assist for helping an infirm or arthritic person rise from the chair. The chair uses no power operated parts. The seat of the chair is elevated and the foot rest is adjustable so that it can be swung by the occupant to either a useful positin or an out-of-the-way position, so that the patient or arthritic person may be seated with the least difficulty and may more easily get out of the chair with the least aid and with the least difficulty.

The chair is provided with a padded seat in a fixed position with relation to its supporting floor. This seat is elevated with respect to a normal chair so that the arthritic person or invalid may simply lean back on it and be seated with the least trouble. That is, the forward edge of the chair seat strikes an adult well above the knees. The adjustably pivoted rest is provided, when placed in its out-of-the-way position, does not interfere with the person standing in front of the chair preparatory to being seated therein or to rising from the chair. The foot rest can be adjustably pivoted out and is vertically adjustable for the purpose of best supporting the feet of the occupant of the chair. The foot rest is solidly supported at four corners. This is a safety feature in that the chair will not pivot over frontwards if the patient stands on the foot rest.

However, in order to assist the patient in getting in and out of the chair, the manually operable lever and linkage allow the patient to, selectively at either side of the chair, pivot the foot rest himself down to a useful substantially horizontal position, or to pivot it back within the confines of the chair where it is out-of-the-way and does not interfere with the patient getting into or out of the chair.

SUMMARY OF THE INVENTION

In view of the foregoing factors and conditions which are characteristic of the prior art it is the primary object of the present invention to provide orthopedic chair which assists an invalid to easily sit therein or to rise therefrom.

It is another object of the present invention to provide an orthopedic chair which does not require a power-driven motor to assist an invalid to get up therefrom.

In accordance with the present invention an embodiment of an orthopedic chair which assists an invalid to easily sit therein or to rise therefrom is described. The orthopedic chair includes a frame, a seat which is pivotally coupled to the frame at the front thereof, a back which is mechanically coupled to the frame, a right arm-rest and a left arm-rest both of which are mechanically coupled to the frame. The orthopedic chair also includes a spring tensioning mechanism which resiliently biases the seat, when it is in its first position, toward its second position and a releasing mechanism which releases the seat so that the spring tensioning mechanism moves the seat from its first position to its second position.

The features of the present invention which are believed to be novel are set forth with particularity in the appended claims.

Other claims and many of the attendant advantages will be more readily appreciated as the same becomes better understood by reference to the following detailed description and considered in connection with the accompanying drawing in which like reference symbols designate like parts throughout the figures.

DESCRIPTION OF THE DRAWING

FIG. 1 is a perspective view of a first embodiment of an orthopedic chair which has been constructed in accordance with the principles of the present invention and which is in a first position.

FIG. 2 is a perspective view of the orthopedic chair of FIG. 1 which is in a second position.

FIG. 3 is a right side elevation view of the orthopedic chair of FIG. 1.

FIG. 4 is a right side elevational view of the orthopedic chair of FIG. 2.

FIG. 5 is a top plan view of the orthopedic chair of FIG. 1.

FIG. 6 is a top plan view of the orthopedic chair of FIG. 2.

FIG. 7 is a top view of the spring loaded latch.

FIG. 8 is a partial, right side elevational view in cross-section of the orthopedic chair of FIG. 1 taken along the line 8—8 of FIG. 7.

DESCRIPTION OF THE PREFERRED EMBODIMENT

Figure 10:
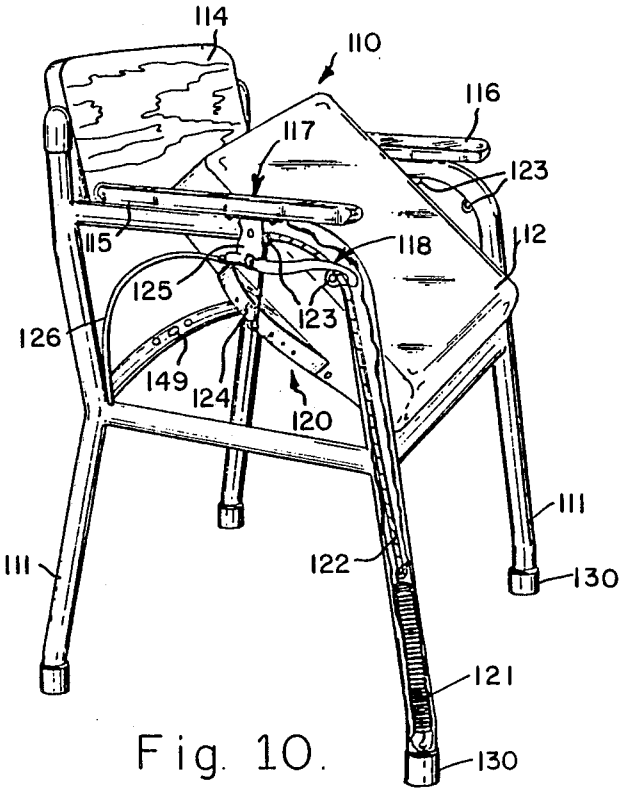
FIG. 10 is a right side elevational view of a second embodiment of an orthopedic chair which has been constructed in accordance with the principles of the present invention and which is in a first position.

In order to best understand the present invention it is necessary to refer to the following description of its preferred embodiment in conjunction with the accompanying drawing. Referring to FIG. 1 in conjunction with FIG. 2 a first orthopedic chair 10 includes a frame 11 and a seat 12 which is pivotally coupled to the frame 11 at the front thereof. The frame 11 may be constructed out of stainless steel, wood, or plastic so long as the material used is strong enough to withstand the force generated, but light in weight. The seat 12 has a center hole so that an invalid may use the first orthopedic chair in conjunction with a toilet. A cover-plate 13 covers the center hole of the seat 12 so that the invalid may use the first orthopedic chair 10 for other activities. The first orthopedic chair 10 also includes a back 14, a right arm-rest 15 and a left arm-rest 16 all of which are mechanically coupled to the frame 11. The first orthopedic chair 10 further includes a seat mechanism 20 for resiliently pivoting the seat 12 so that the seat 12 of the first orthopedic chair 10 may be used to assist an invalid to easily sit therein or to rise therefrom.

Referring to FIG. 3 in conjunction with FIG. 4 the seat mechanism 20 includes a spring tensioning mechanism and a releasing mechanism. The spring tensioning mechanism includes a pair of springs 21, a pair of cable 22 and two sets of pulleys 23. Each of the springs 21 has a first end which is mechanically coupled to the base of the frame 11 and a second end which is mechanically coupled to a first end of one of the cables 22. Each cable 22 is threaded through one of the sets of pulleys 23 so that the second end of each cable 22 is secureably coupled to the seat 12 by a first adjusting device 24. The spring tensioning mechanism resiliently biases the seat 12, when it is in its first position, toward its second position.

Referring to FIG. 3 in conjunction with FIG. 4, FIG. 5 and FIG. 6 the releasing mechanism includes a release lever 25 and a release cable 26 which is mechanically coupled to the release lever 25. The release lever 25 and the cable 26 may be modified from a bicycle hand-brake lever and its cable. The releasing mechanism also includes a spring loaded latch 27 which is mechanically coupled to the cable 26 and which releases the seat 12 so that the spring tension mechanism moves the seat 12 from its first position to its second position.

Referring to FIG. 5 in conjunction with FIG. 6, FIG. 7 and FIG. 8 the spring loaded latch 27 includes a tubular casing 70, a pin 71 which is resiliently coupled within the tubular casing 70. The spring loaded latch 27 also includes a pair of mounting member 72 for secureably coupling the tubular casing 70 to the seat 12. The frame has a pin-stop 73 which is mechanically coupled to the frame 11 and which engages the pin 71 and a casing-stop 74 which is mechanically coupled to the frame 11 and which secures the tubular casing in place when it is under tension.

Figure 9:
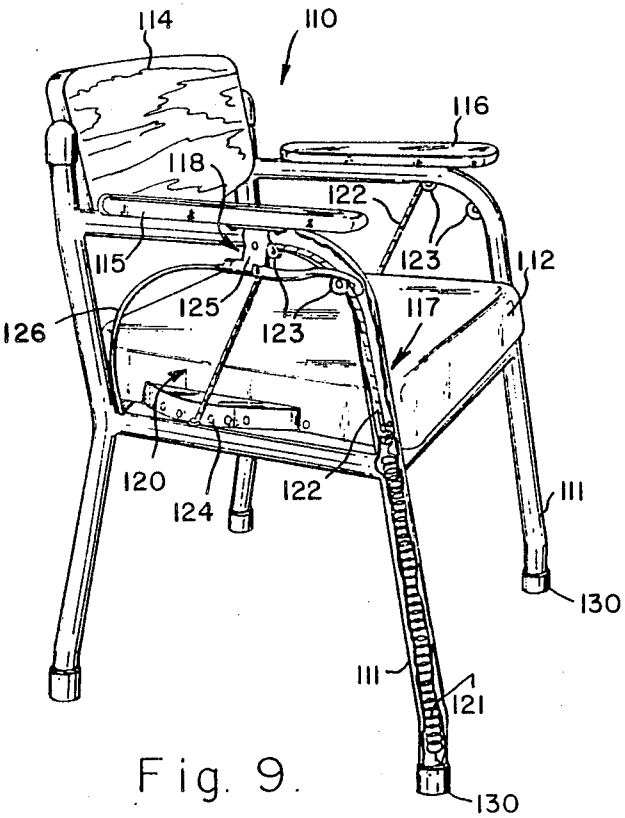
FIG. 9 is a partial perspective view of the seat of the orthopedic chair of FIG. 1 showing a first tension-adjusting mechanism.
Figure 12:
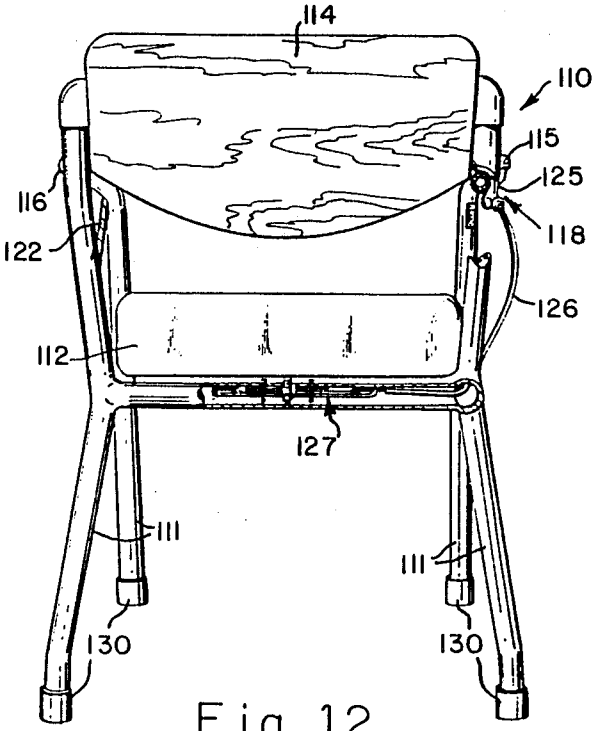

Referring to FIG. 9 in conjunction with FIG. 3 the first adjusting device 24 is secureably coupled to the seat 12. The first adjusting device 24 allows adjusting the length of the cable 22 in order to adjust the spring tension in each spring 21.

Figure 11:
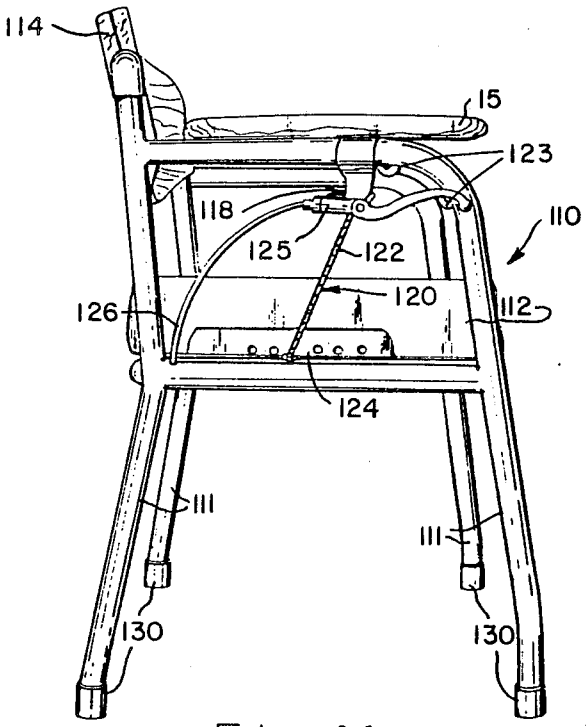
FIG. 11 is a partial, right side elevational view of the orthopedic chair of FIG. 10 showing a second tension-adjusting mechanism.
Figure 15:
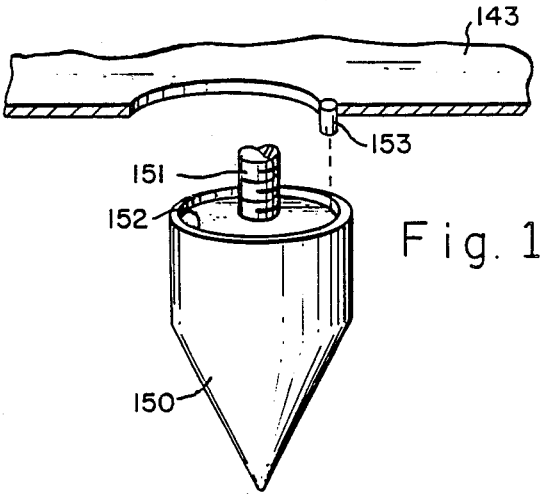
Figure 19:
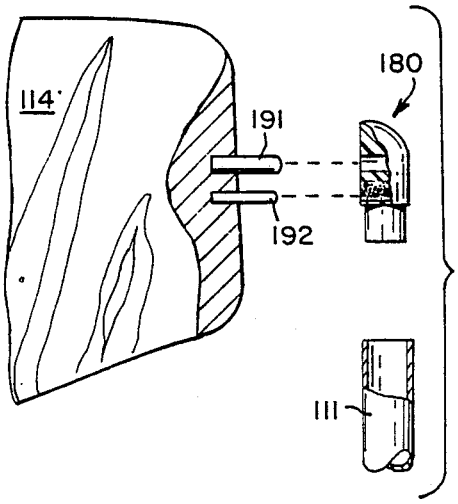
Figure 18:
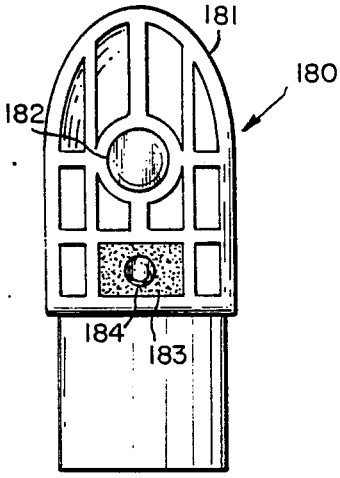
Figure 20:
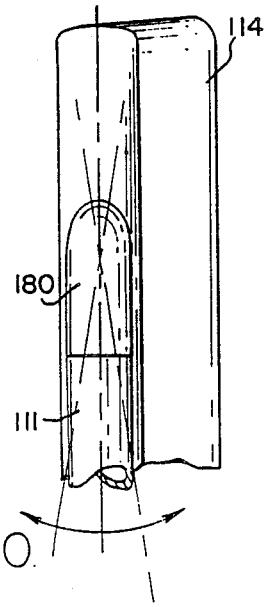
Figure 21:
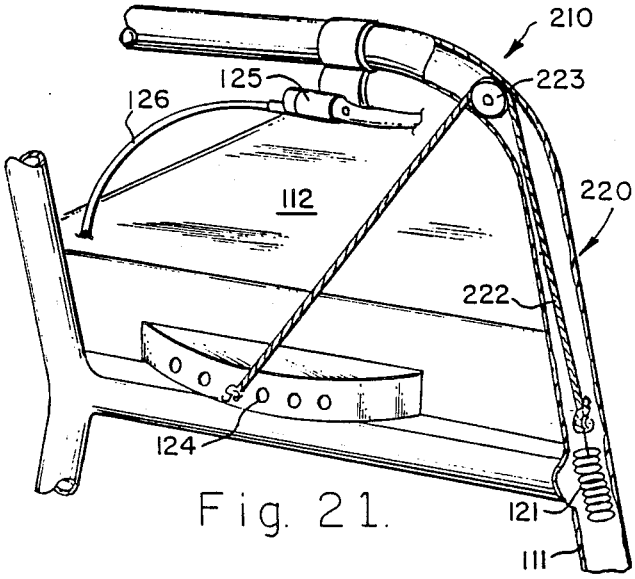

Referring to FIG. 10 in conjunction with FIG. 11 a second orthopedic chair 110 includes a frame 11 and a seat 12 which is pivotally coupled to the frame 11 at the front thereof. The second orthopedic chair 110 also includes a back 13, a right arm-rest 15 and a left arm-rest all of which are mechanically coupled to the frame 11. The second orthopedic chair 110 further includes a seat mechanism 120 for resiliently pivoting the seat 12 so that the seat 12 of the second orthopedic chair 110 may be used to assist an invalid to easily sit therein or to rise therefrom. The seat mechanism 120 includes a spring tensioning mechanism and a releasing mechanism. The spring tensioning mechanism includes a pair of rubber tubes 122, two sets of pulleys 23 and a pair of second adjusting devices each of which includes a pulley 123, a pulley-mount 124 on which the pulley 123 is mounted and a slide-rack 125 to which the pulley-mount 124 is securely, but detachably, coupled. Each of the rubber tube 122 has a first end which is mechanically coupled to the base of the frame 11. Each rubber tube 122 is threaded through one of the sets of pulleys 23 and the adjusting pulleys 123 so that the second end of each rubber tube 122 is secureably coupled to the seat 12 by the second adjusting device. The spring tensioning mechanism resiliently biases the seat 12, when it is in its first position, toward its second position.

From the foregoing it can be seen that a system for a seat mechanism for resiliently pivoting the seat of an orthopedic chairs in order to assist an invalid to easily sit therein or to rise therefrom has been described. It should be noted that the sketches are not drawn to scale and that distance of and between the figures are not to be considered significant.

Accordingly it is intended that the foregoing disclosure and showing made in the drawing shall be considered only as an illustration of the principles of the present invention.

What is claimed is:

1. An orthopedic chair comprising:

a. a frame;

b. a seat which is pivotally coupled to said frame at the front thereof;

c. a back which is mechanically coupled to said frame;

d. a pair arm-rests which are mechanically coupled to said frame;

e. a pair of rubber tubes each of which has a first end which is mechanically coupled to the base of said frame;

f. a pair of pulley systems, each of which includes two pulleys which are disposed in series and mechanically coupled to said frame above said seat and through each of which the second end of one of said rubber tubes is threaded and wherein the second end of said rubber tube securably coupled to said seat whereby said rubber tubes resiliently bias said seat, when it is in its first position, towards its second position so that said seat may be used to assist an invalid to easily sit therein or to rise therefrom; and h. releasing means for releasing said seat so that said rubber tubes moves said seat from its first position to its second position.

2. An orthopedic chair according to claim 1 wherein said releasing means comprises:

a. a release lever which is mechanically coupled to one of said arm-rests;

b. a release cable which is mechanically coupled to said release lever;

c. a pin stop is mechanically coupled to said frame;

d. a latching mechanism including a housing which is mechanically coupled to said seat and a pin which is mechanically coupled to said release cable and which is disposed and resiliently biased within said housing, said pin engaging said pin stop whereby the movement of said pin causes said pin to move away and disengage from said pin stop in order for said springs to move said seat from its first position to its second position; and e. restraining means for restraining the movement of said pin so that said pin can not move away from said pin stop unless a person is sitting in said orthopedic chair.

* * * * *